US006447862B1

(12) United States Patent
Rankin et al.

(10) Patent No.: US 6,447,862 B1
(45) Date of Patent: Sep. 10, 2002

(54) PRODUCT INFORMATION LABEL

(75) Inventors: Bruce C. Rankin, Eagan; Dennis J. Tursso, Sunfish Lake, both of MN (US)

(73) Assignee: Product Engineering, Inc., St. Paul, MN (US)

( * ) Notice: Subject to any disclaimer, the term of this patent is extended or adjusted under 35 U.S.C. 154(b) by 147 days.

(21) Appl. No.: 09/593,796

(22) Filed: Jun. 14, 2000

(51) Int. Cl.[7] ..... B42D 15/00

(52) U.S. Cl. ..... 428/40.1; 281/2; 281/5; 283/81; 283/101; 428/41.7; 428/41.8; 428/42.2; 428/192; 428/194

(58) Field of Search ..... 428/40.1, 41.7, 428/41.8, 42.2, 192, 194; 281/2, 5; 283/81, 101

(56) References Cited

U.S. PATENT DOCUMENTS 5,804,271 A * 9/1998 Barry ..... 428/40.1
5,866,219 A * 2/1999 McClure ..... 428/40.1

* cited by examiner

*Primary Examiner*—Nasser Ahmad
(74) *Attorney, Agent, or Firm*—Hugh D. Jaeger

(57) ABSTRACT

Product information label having a planar base and a product information pamphlet beneath a protective layer which is applied to a product and/or a product container where the pamphlet is accessed for viewing and resealed for subsequent reference and use.

4 Claims, 3 Drawing Sheets

PRODUCT INFORMATION LABEL

CROSS REFERENCES TO CO-PENDING APPLICATIONS

None.

BACKGROUND OF THE INVENTION

1. Field of the Invention

The present invention is for a product information label, and more particularly, pertains to a readily openable and resealable product information label having protected easy to read pamphlet information panels for dissemination of product information.

2. Description of the Prior Art

Product information accompanying a product is furnished in several ways in the prior art. It may come in the form of a label attached directly to the product or product container, it may come in the form of textual material printed on the product package, or it may come as a separate booklet or packet included in the product container itself or inserted into the product package along with the product or product container. At present, all of these schemes for supplying product information to the consumer have various shortcomings.

In more particular, and looking first to the label form of furnishing product information, a major shortcoming of that form is that the space available on the label for accommodating the myriad of required information data which must be furnished with the product is usually so small that such data is difficult to read, at best, due to the small size print which must be used in order to fit the required data to the limited pace available. Reading of this small size print often requires the use of optical devices, such as magnifying devices. As a result, many times important information is misinterpreted or conveniently ignored because it is so difficult to extricate. Thus, users are often prone to neglect such small and difficult to read information, thereby resulting in improper usage of the product.

Another shortcoming of prior art information labels is the lack of protection for the printed textual portion of the labels, the absence of which may result in the printed textual portion becoming soiled, torn, dog-eared or otherwise damaged to the extent that all or a portion of the printed text is illegible.

Yet another shortcoming existing with many prior art product information labels is the inability to gain access to the printed textual portion of the labels quickly and easily, and the lack of any provision for resealing after access is completed.

As to the use of product information provided as a separate booklet or packet included in the product container itself or inserted into the product package along with the product or product container, such booklet or packet oftentimes has the same small size print as labels, but even if it has print of a larger size, since it is not physically attached to the actual product or product container, the user is free to discard the booklet or packet with utter disregard to retaining it for future reference. Even if the user does have the foresight to retain the booklet or packet, it can become disassociated from the product or product container and lost. The same is true when the product information is printed on the product package, inasmuch as the product package is almost always routinely discarded or, if retained, becomes separated from the product or product container and is unable to be located when needed.

Clearly what is needed is a product information label which securely attaches to a product or a product container so as always to be associated therewith, which can be accessed quickly and easily, which includes proper protection for the printed textual material, which includes adequate space to enable use of a sufficiently large type size so as to be easily readable, and which is resealable.

SUMMARY OF THE INVENTION

The general purpose of the invention is to provide an improved product information label.

According to one embodiment of the present invention there is provided a product information label having a pamphlet suitably attached to the top surface of a planar base. The pamphlet is composed of multiple product information printed paper or other suitable material panels covered by a transparent polypropylene plastic laminate, having an acrylic pressure sensitive adhesive such as EVCO EV158 on its underside, which is secured along the pamphlet and to the planar base. The lower region of the transparent polypropylene plastic laminate secures to the top surface of the planar base by an ultraviolet cured adhesive release coating such as Sure Cure® UCCXX0047 (UV8960 ) located on the top surface of the planar base which allows the user to easily disengage a cover tab at the lower region of the transparent polypropylene plastic laminate so that printed matter on the multiple pamphlet panels may be viewed. Subsequent to pamphlet viewing, the user can reseal the lower region of the transparent polypropylene plastic laminate overlying the pamphlet to the top surface of the planar base for future reference.

One significant aspect and feature of the present invention is a product information label for dissemination of product information.

Another significant aspect and feature of the present invention is a product information label which attaches to a product or a product container.

Another significant aspect and feature of the present invention is a product information label having a pamphlet attached to a planar base.

Another significant aspect and feature of the present invention is a product information label having product information pamphlet panels.

Another significant aspect and feature of the present invention is a product information label having pamphlet panels which can accommodate an abundance of suitable text information.

Another significant aspect and feature of the present invention is a product information label having pamphlet panels which secure and pivot about a horizontal area, or in the alternative, about a vertical area.

Another significant aspect and feature of the present invention is a product information label having a protective transparent polypropylene plastic laminate covering underlying pamphlet panels.

Another significant aspect and feature of the present invention is a product information label having a protective transparent polypropylene plastic laminate with acrylic pressure sensitive adhesive on its underside.

Another significant aspect and feature of the present invention is the use of a UV cured adhesive release coating on a planar base which contacts the acrylic pressure sensitive adhesive on the underside of a transparent polypropylene plastic laminate for purposes of sealing and resealing subsequent to release.

Another significant aspect and feature of the present invention is a product information label having a living hinge.

Another significant aspect and feature of the present invention is a product information label having sufficient space to enable accommodation of all the required information data for the product in a conveniently readable type size.

Another significant aspect and feature of the present invention is a product information label wherein the product information can be accessed quickly and easily and which is resealable.

Having thus described significant aspects and features of the present invention, it is the principal object of the present invention to provide an improved product information label.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
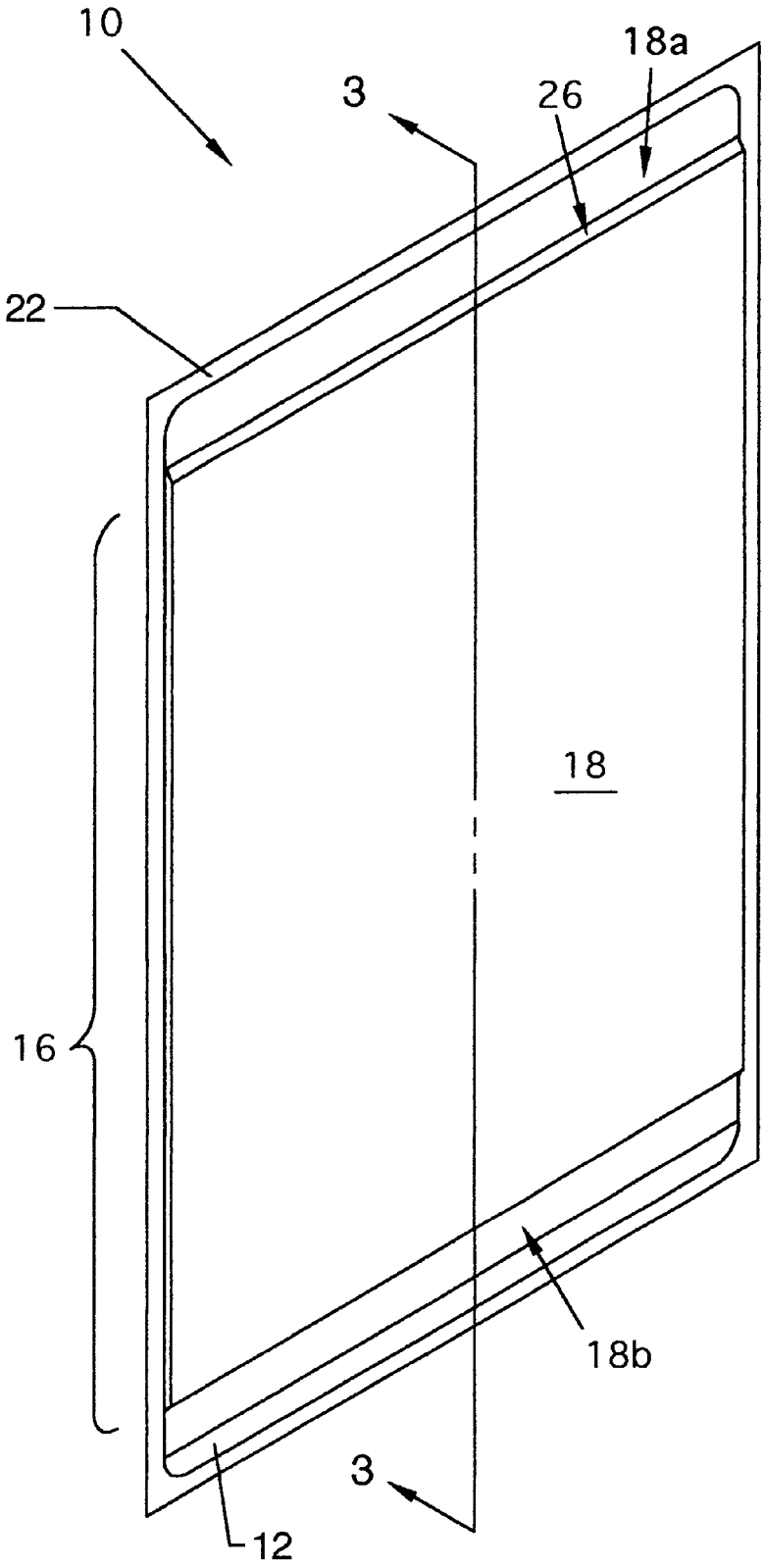
FIG. 1 illustrates an isometric view of a product information label, the present invention, in a position ready for use.
Figure 2:
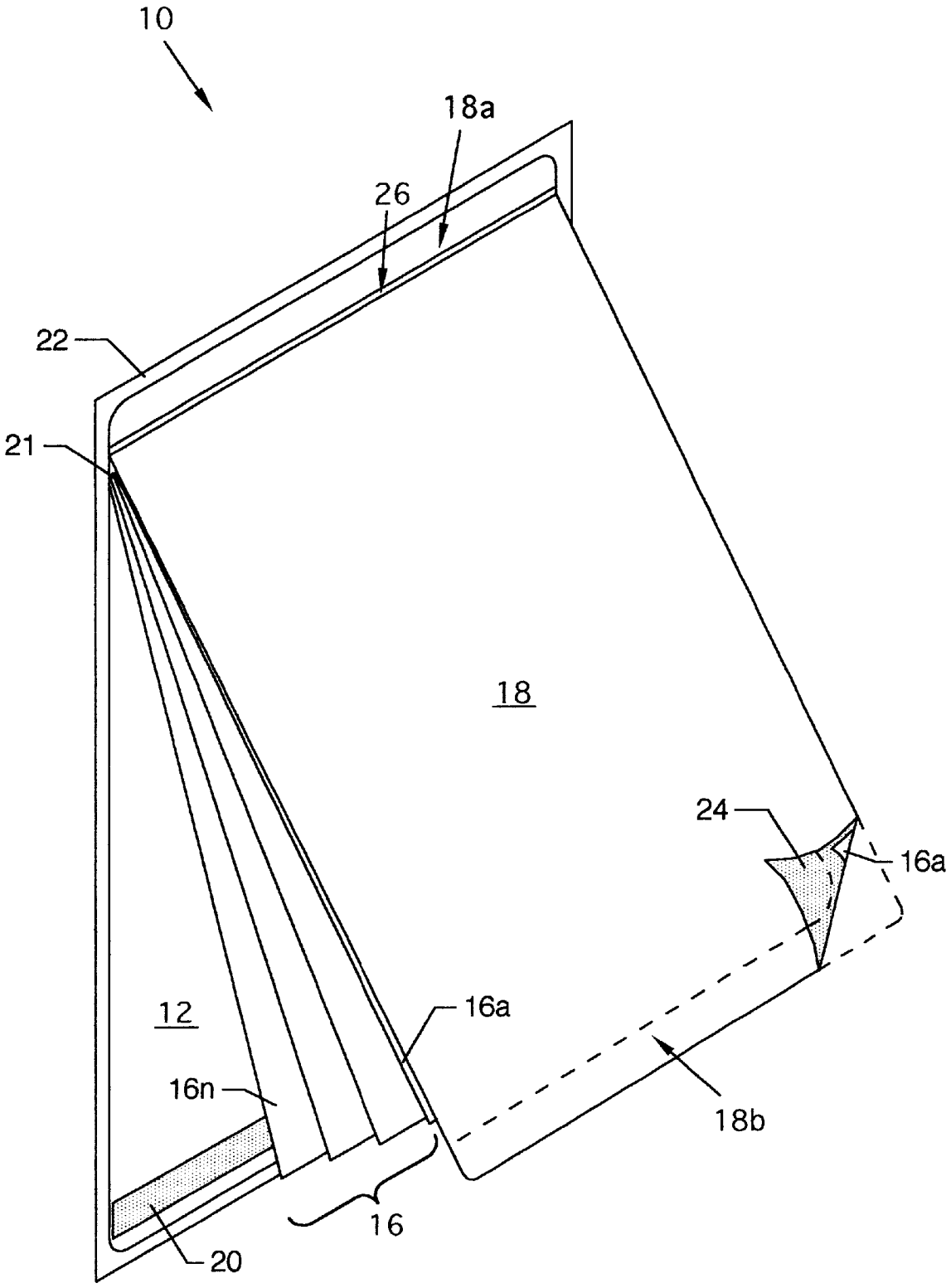
FIG. 2 illustrates an isometric view of the product information label in the initial step of accessing information from a pamphlet; and, FIG. 3 illustrates a conceptual cross sectional view of the product information label along line 3—3 of FIG. 1.

FIGS. 1 and 2 illustrate isometric views of a product information label 10, the present invention, FIG. 1 showing the invention ready for use, and FIG. 2 showing the invention in the semi-deployed mode where information can be referenced. The product information label 10 includes an underlying planar base 12, preferably of paper; but any other suitable material or combination of materials which can have printed product information thereupon can be used for the planar base 12. Alternatively, no printing need be included, if desired. A pamphlet 16 is affixed to the underside of a transparent polypropylene plastic laminate 18, as later described in detail. Pamphlet 16 is composed of multiple printed product information paper or other suitable material pamphlet panels 16*a*–16*n* of which the top surface of the panel 16*a* contacts an acrylic pressure sensitive adhesive 24 (FIG. 3) located on the underside of the transparent polypropylene plastic laminate 18. A portion of the transparent polypropylene plastic laminate 18 is a planar tab 18*a* which includes acrylic pressure sensitive adhesive 24 adhesively secured to and along the top surface of the planar base 12 near the upper edge of the planar base 12. A tab 18*b* at the lower edge of the transparent polypropylene plastic laminate 18 includes acrylic pressure sensitive adhesive 24 and extends beyond the combined lower edges or free ends of the pamphlet panels 16*a*–16*n* of the pamphlet 16 and secures to the top surface of the planar base 12 near the lower edge of the planar base 12 by contacting an ultraviolet cured adhesive release coating 20, which allows the user to easily disengage the tab 18*b* so that the transparent polypropylene plastic laminate 18 and attached pamphlet 16 may be pivoted away from the planar base 12 and the printed matter on the pamphlet panels 16*a*–16*n* may be viewed. It should be noted that there is no attachment of any kind between the bottom surface of the bottom panel 16*n* and the top surface of the planar base 12. The complete absence of any attachment between these two surfaces enables the entire pamphlet, including the bottom panel 16*n* thereof, to be pivoted about the living hinge 26 to gain access to both surfaces of all of the panels 16*a*–16*n*. Subsequent to pamphlet viewing, the user can reseal the tab 18*b* to the ultraviolet cured adhesive release coating 20 on the planar base 12 for future reference. A removable backing panel 22 is adhesively attached to the bottom surface of the planar base 12. Removal of the backing panel 22 reveals an adhesive for subsequent attachment of the product information label to a suitable surface of a product or a product container, as shown in FIG. 3.

FIG. 2 illustrates the initial step of accessing information from the pamphlet 16 of the product information label 10, where all numerals mentioned previously correspond to those elements previously described. The first step is to manually lift the transparent polypropylene plastic laminate tab 18*b* from engagement at the lower region of the planar base 12. More specifically, the lifting of the transparent polypropylene plastic laminate tab 18*b* causes the acrylic pressure sensitive adhesive 24 on the underside of the transparent polypropylene plastic laminate tab 18*b* to adhesively disengage from the ultraviolet cured adhesive release coating 20 located on the top surface of the planar base 12 to allow access and viewing of the information pamphlet panels 16*a*–16*n*, each having product information printed on one or more appropriate surfaces. The top surface of the top panel 16*a* is secured to the underside of the transparent polypropylene plastic laminate 18, and the remaining panels 16*b*–16*n* are free to be further deployed for informational browsing. Product information can also be printed on the top surface of the top panel 16*a* for viewing through the transparent polypropylene plastic laminate 18.

MODE OF OPERATION

Figure 3:
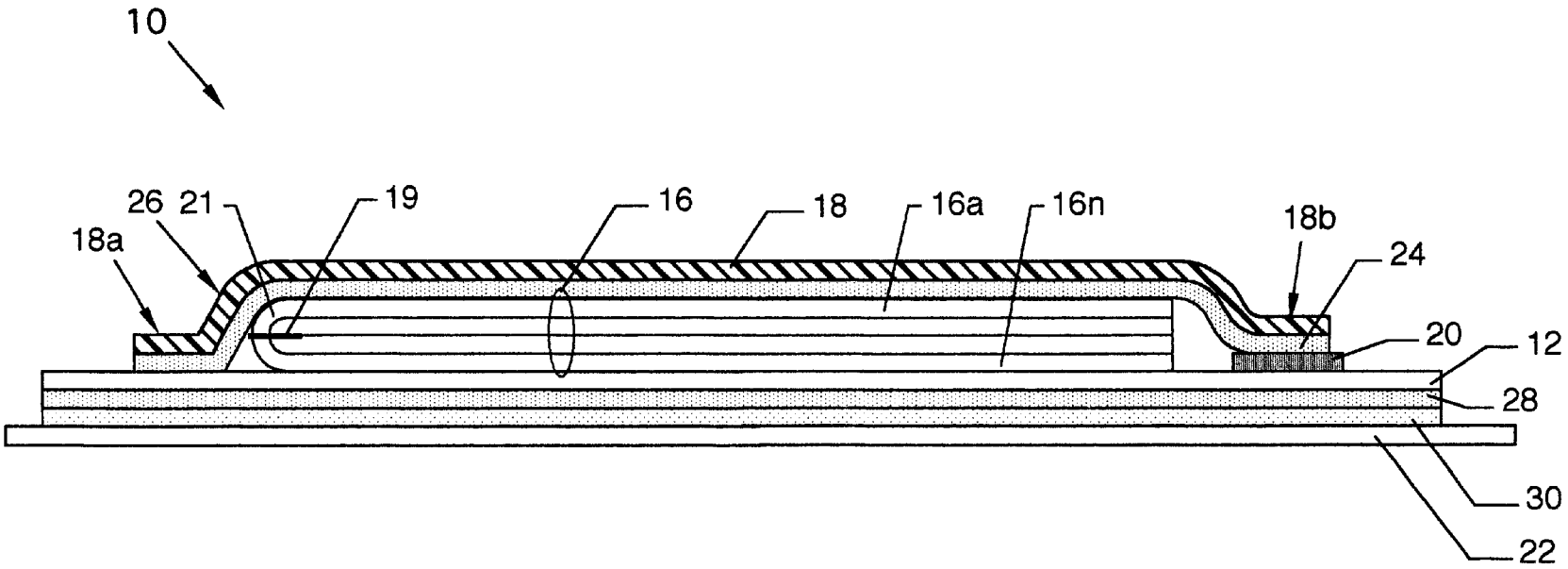

FIG. 3 illustrates a conceptual cross sectional view of the product information label 10 along line 3–3 of FIG. 1, where all numerals mentioned previously correspond to those elements previously described. Illustrated in particular is the method of attachment of the pamphlet panels 16*a*–16*n* to the planar base 12 and to each other. The pamphlet panels 16*a*–16*n* are attached together by one or more staples 19 at a multi-layer fold 21 in the pamphlet 16. The transparent polypropylene plastic laminate 18 aligns over and about the top pamphlet panel 16*a* of the pamphlet 16 and includes tabs 18*a* and 18*b* each of which extends a short distance beyond the upper and lower edges of the pamphlet 16. The acrylic pressure sensitive adhesive 24 is located on the underside of the transparent polypropylene plastic laminate 18 including the undersides of tabs 18*a* and 18*b*. The majority of the acrylic pressure sensitive adhesive 24 is disposed between the tabs 18*a* and 18*b* and adhesively fastens the transparent polypropylene plastic laminate 18 to the top pamphlet panel 16*a*. The acrylic pressure sensitive adhesive 24 extends beyond the pamphlet 16 on the underside of tab 18*a* and secures the tab 18*a* and thus the transparent polypropylene plastic laminate 18 and attached pamphlet 16 to the planar base 12. The tab 18*b*, which extends beyond the pamphlet 16, also includes an extended layer of acrylic pressure sensitive adhesive 24 utilized to releasably secure the tab 18*b* to the ultraviolet cured adhesive release coating 20 transversely located across the lower region of the planar base 12. One representative release coating, by way of example and for purposes of illustration only and not to be construed as limiting of the present invention, is 97% varnish AZKO NOBEL UV-8960 mixed with AZKO NOBEL 3% surfactant liquid IOSF2 003-2C. This mixture is laid on a 100% coating of SUNKOTE PRIMER RGE 00838 G/C. Release area is flexo coated with a silicone varnish and cured with UV light. The amount of silicone in the varnish can be changed depending on the desired release aggressiveness. The area of the transparent polypropylene plastic laminate 18 adjacent to where the tab 18*a* attaches to the planar base 12 acts as a living hinge 26 for pivoting of the transparent polypropylene plastic laminate 18 and pamphlet 16 away from the planar base 12 for viewing of the pamphlet 16. An adhesive 28 is located on the bottom surface of the planar base 12 for adhering the planar base 12 to a product or a product container. A layer of silicone release material 30 is disposed between the adhesive 28 and the backing panel 22 for easy removal of the backing panel 22. The use of the ultraviolet cured adhesive release coating 20 allows for excellent sealing and resealing characteristics, whereby the information can be accessed many times while still being able to stow and reseal the pamphlet 16 in a satisfactory manner between the planar base 12 and the transparent polypropylene plastic laminate 18.

Various modifications can be made to the present invention without departing from the apparent scope hereof.

It is claimed:

1. A product information label comprising:

a. a planar base having a top surface and a bottom surface, said top surface having a strip of ultraviolet cured adhesive release coating thereon adjacent to an edge thereof, and said bottom surface being fixable to a product or to a product container;

b. a transparent plastic laminate having an upperside and an underside, said underside having pressure sensitive adhesive thereon;

c. a pamphlet having a spine and multiple panels emanating from said spine, said pamphlet being formed of a plurality of aligned and stacked planar sheets folded in half along a fold line and joined together at said fold line by at least one staple extending through said sheets and through said fold line, said fold line constituting said spine and each half of each folded planar sheet constituting one of said multiple panels, each panel having top and bottom surfaces and a free end spaced from said fold line, one of said panels constituting a top panel and having its top surface permanently adhesively secured to said underside of said transparent plastic laminate by said pressure sensitive adhesive on said underside of said transparent plastic laminate, another of said panels constituting a bottom panel, all additional ones of said panels being intermediate panels positioned between said top panel and said bottom panel, and at least some of said panels having printed information on at least one surface thereof;

d. a first edge of said transparent plastic laminate extending beyond said fold line and being adhesively secured to said top surface of said planar base by said pressure sensitive adhesive on said underside of said transparent plastic laminate, thereby forming a living hinge for pivoting of said transparent plastic laminate and all of said panels away from said planar base;

e. a second edge of said transparent plastic laminate extending beyond said free ends of said panels and being releasably secured to said strip of ultraviolet cured adhesive release coating on said top surface of said planar base by said pressure sensitive adhesive on said underside of said transparent plastic laminate; and, f. said product information label being further characterized by the complete absence of any attachment of any kind between the bottom surface of said bottom panel of said pamphlet and said top surface of said planar base such that said pressure sensitive adhesive on said underside of said transparent plastic laminate can be released from said strip of ultraviolet cured adhesive release coating on said top surface of said planar base to permit said transparent plastic laminate to be pivoted about said living hinge to thereby gain access to both surfaces of all of said panels of said pamphlet for browsing of said printed information thereon and then pivoted back about said living hinge and resealed to said strip of ultraviolet cured adhesive release coating on said top surface of said planar base.

2. The product information label as claimed in claim 1, and further comprising an adhesive on said bottom surface of said planar base.

3. The product information label as claimed in claim 2, and further comprising a removable backing panel covering said adhesive on said bottom surface of said planar base.

4. The product information label as claimed in claim 3, and further comprising a layer of silicone release material between said removable backing panel and said adhesive on said bottom surface of said planar base.

* * * * *